US005215021A

United States Patent [19]

Fuhrmann

[11] Patent Number: 5,215,021

[45] Date of Patent: Jun. 1, 1993

[54] NEEDLE WITH TRIANGULAR END AND THERMAL LOAD REDUCING EYE

[75] Inventor: Wolf-Dieter Fuhrmann, Aachen, Fed. Rep. of Germany

[73] Assignee: Singer Spezialnadelfabrik GmbH, Würselen, Fed. Rep. of Germany

[21] Appl. No.: 889,787

[22] Filed: May 27, 1992

[30] Foreign Application Priority Data

May 29, 1991 [DE] Fed. Rep. of Germany ... 9106591[U]

[51] Int. Cl.[5] ..... D05B 85/00

[52] U.S. Cl. ..... 112/222

[58] Field of Search ..... 112/28, 35, 37, 49, 112/54, 80.01, 171, 281, 222, 223, 224; 223/99; 28/115; 163/1, 5; D15/72; 606/222, 223; 69/7.7

[56] References Cited

U.S. PATENT DOCUMENTS

| | | | |
|---|---|---|---|
| 568,946 | 10/1886 | Hanna | 112/222 |
| 2,092,929 | 9/1937 | Ovington | 606/222 X |
| 3,521,583 | 7/1970 | Pozzolo | 112/222 X |
| 3,929,082 | 12/1975 | Zocher | 112/222 |
| 3,986,468 | 10/1976 | Szostak et al. | 112/222 |
| 4,194,457 | 3/1980 | Parsons | 112/222 |
| 4,233,917 | 11/1980 | Carnaby | 112/222 |
| 4,519,330 | 5/1985 | Zylbert et al. | 112/222 |
| 5,046,438 | 9/1991 | Hakui | 112/222 |

FOREIGN PATENT DOCUMENTS

| | | | |
|---|---|---|---|
| 2623796 | 6/1977 | Fed. Rep. of Germany | 112/222 |
| 1-195892 | 8/1989 | Japan | 112/222 |
| 1428360 | 10/1988 | U.S.S.R. | 606/223 |

OTHER PUBLICATIONS

Das ABC der Schuele Fabrikatics, 1934, p. 1747.

*Primary Examiner*—Clifford D. Crowder
*Assistant Examiner*—Ismael Izaguirre
*Attorney, Agent, or Firm*—Robert W. Becker & Associates

[57] ABSTRACT

A sewing machine needle has a piston for clamping the needle into a sewing machine, a needle shaft comprised of a shaft portion and an end piece with a tip, whereby the needle shaft has a needle eye between the shaft portion and the end piece for receiving a sewing thread. A conical portion connected to the piston forms a transition into the needle shaft. The end piece, between the tip and the needle eye, has a triangular radial cross-section with rounded corners, whereby the size of the triangular cross-section increases from the tip toward the needle eye, and whereby the triangular cross-section has its greatest size in the vicinity of the needle eye. The needle shaft, in the area of the needle eye, has an essentially circular cross-section, and this circular cross-section has a size that is smaller than the greatest size of the triangular cross-section.

2 Claims, 2 Drawing Sheets

NEEDLE WITH TRIANGULAR END AND THERMAL LOAD REDUCING EYE

BACKGROUND OF THE INVENTION

1. Field of the Invention

The present invention relates to a sewing machine needle, especially for industrial sewing machines, comprising a piston for clamping the needle into the respective sewing machine and a conical portion connected to the piston and forming a transition into the needle shaft. The needle shaft comprises a shaft portion and an end piece, with a needle eye for receiving a sewing thread being disposed between the shaft portion and the end piece.

2. Description of the Related Art

In the industrial finishing section of the sewing industry a high sewing speed is desired for economical reasons which leads to a heating of the sewing machine needle. This heating of the sewing machine needle results from the friction between the needle and the textile material being sewn and poses a plurality of problems for the sewing industry. A high needle temperature not only results in heat damage to natural fibers, but also causes softening and melting of synthetic fibers. Further disadvantages of high needle temperatures are not only the rupture of the threads during sewing of synthetic fibers, but also the deposition of melted particles of the synthetic fiber material at the needle, especially within the needle eye or within the thread guiding groove which ultimately leads to the needle being unsuitable for further use. Furthermore, the needle itself is effected by the high needle temperature because its hardness is reduced so that a deformation or bending of the needle or even breakage can occur.

The magnitude of the needle heating generated at the contact area between the needle and the textile material depends mainly on the following factors: Textile sizing, textile density, number of textile layers to be sewn, thread sizing, and primarily the sewing speed. These factors cannot be influenced by the sewing needle.

It is therefore an object of the present invention to prevent the heating of the sewing machine needle caused by the aforementioned factors by a special needle design and to provide thereby a reduced thermal load at the sewing thread and the textile material as well as at the needle even under the high loads experienced by the sewing machine needles.

SUMMARY OF THE INVENTION

The sewing machine needle according to the present invention is primarily characterized by a piston for clamping the needle into a sewing machine; a needle shaft comprised of a shaft portion and an end piece with a tip, the needle shaft having a needle eye between the shaft portion and the end piece for receiving a sewing thread; a conical portion connected to the piston and forming a transition into the needle shaft; the end piece, between the tip and the needle eye, having a triangular cross-section with rounded corners, with a size of the triangular cross-section increasing from the tip toward the needle eye, the triangular cross-section having a greatest size in the vicinity of the needle eye; and the needle shaft, in the area of the needle eye, has an essentially circular cross-section, whereby the circular cross-section is smaller than the greatest size of the triangular cross-section.

Preferably the circular cross-section is smaller than a cross-section of the shaft portion of the needle shaft.

With the inventive embodiment of a sewing machine needle a kind of free stitching effect for the thread-guiding needle eye portion of the needle is generated resulting in a substantially reduced thermal load of the needle thread. The needle shaft in the area of the needle eye, which in its cross-sectional dimensions is reduced relative to the triangular cross-section of the end piece and which is provided with an essentially circular outer contour, is subjected to reduced friction by the textile material resulting in a local reduction of the frictional heating of the needle. In practical applications, the inventive sewing machine needles provided an increase in the sewing distance of approximately 90% until thread rupture occurred under critical sewing conditions, i.e. essentially a doubling of the sewing distance could be achieved. These advantages are substantially based on a reduction of the needle temperature within the needle eye area due to the inventive cross-sectional design: the needle temperature within the needle eye area in conventional sewing machine needles may reach up to 350° C.

A further improvement of the inventive sewing machine needle may be achieved when according to a further feature of the invention the cross-section of the needle shaft within the area of the needle eye is reduced with respect to the cross-section in the adjacent needle shaft portion.

In the prior art sewing machine needles with so-called triangular end pieces are known. They are used for sewing leather and similar materials which are difficult to penetrate whereby the triangular end pieces are ground to form sharp edges in order to reduce the resistance of the penetrating needle due to the cutting effect of the edges. Such needles with sharp edges are however not suitable for sewing textile materials since damages of the textile bonding would occur which is not acceptable. It is an important consideration that sewing machine needles for textile materials must have end pieces which penetrate the material to be sewn simply by a displacement effect.

BRIEF DESCRIPTION OF THE DRAWINGS

This object and other objects of the present invention will appear more clearly from the following specification in conjunction with the accompanying drawings, in which.

DESCRIPTION OF THE PREFERRED EMBODIMENTS

The present invention will now be described in detail with the aid of a specific embodiment utilizing FIGS. 1 through 4.

Figure 1:
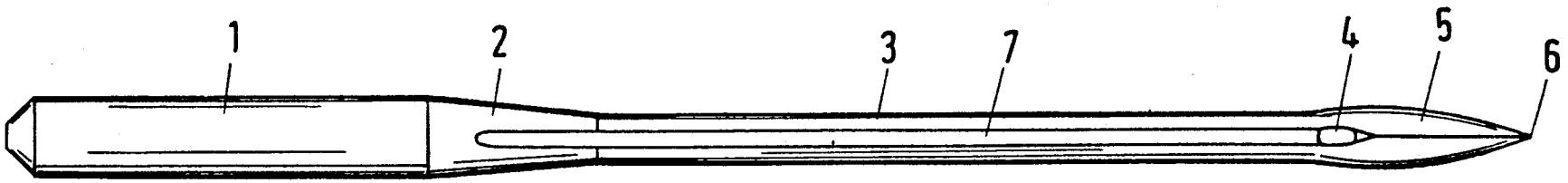
FIG. 1 is a plan view of a sewing machine needle.

The sewing machine needle represented in FIG. 1 is comprised of a cylindrical piston 1 via which the needle is clamped into the needle rod of a sewing machine. Connected to the piston 1 is a conical portion 2 which forms a transition into the needle shaft of an essentially circular cross-section. The needle shaft is comprised of a shaft portion 3 and an end piece 5 with a tip 6. The needle shaft has a needle eye 4 arranged between the shaft portion 3 and the end piece 5 for receiving a sewing thread. A top side of the shaft portion 3 is provided with a thread guiding groove 7.

Figure 3:
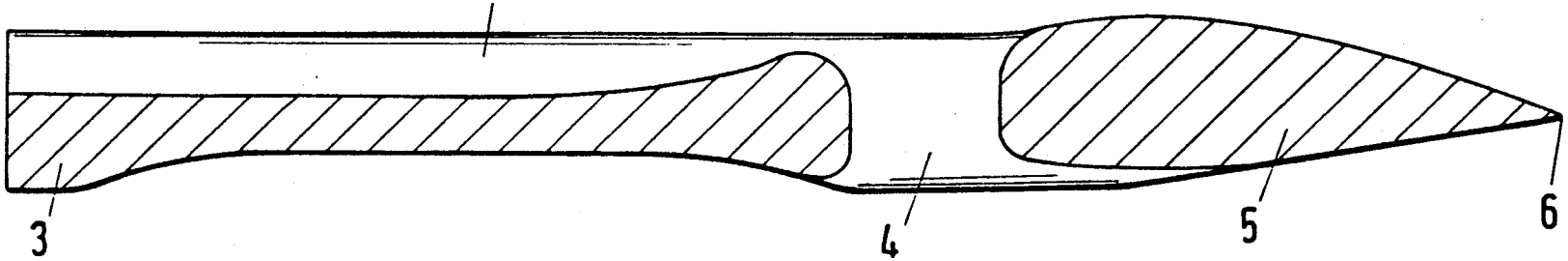
FIG. 3 is a longitudinal cross-section of the needle shaft and end piece of the needle along the line III—III in FIG. 2.
Figure 2:
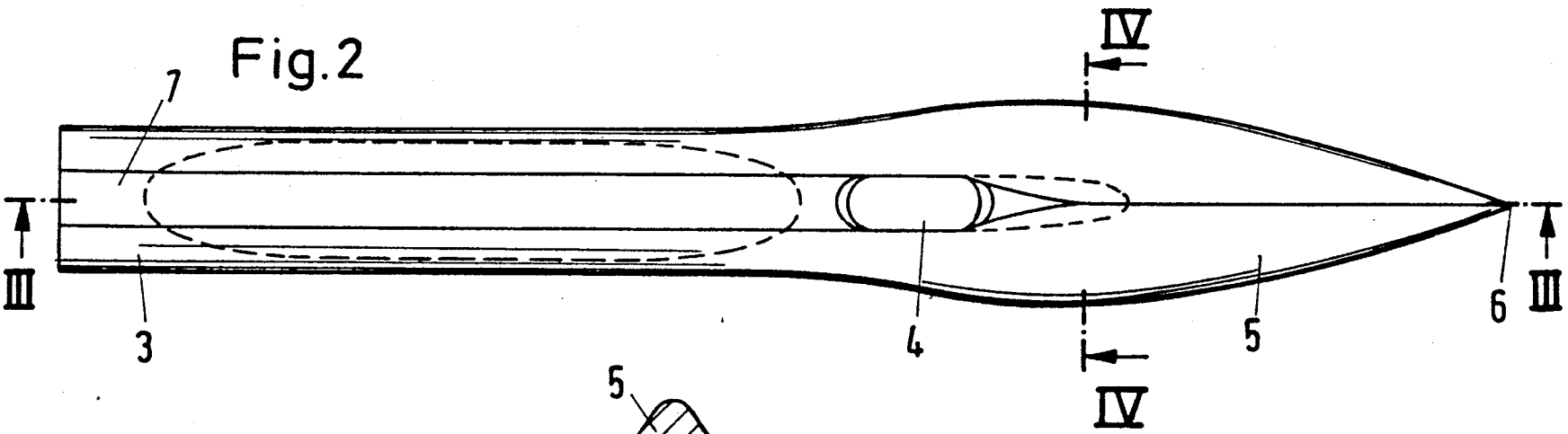
FIG. 2 is a representation corresponding to FIG. 1 showing the needle shaft and end piece of the needle in a detailed view.
Figure 4:
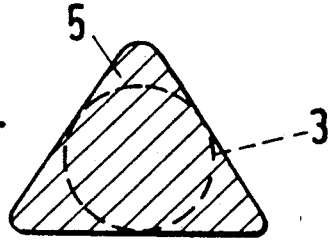
FIG. 4 is a cross-section of the end piece of the needle along the line IV—IV in FIG. 2.

As can be seen from FIGS. 2 to 4, the end piece 5, i.e., the portion of the needle between the outer tip 6 and the needle eye 4, is provided with a triangular radial cross-section having rounded corners (see FIG. 4). This triangular cross-section increases from the outer tip 6 to the area of the needle eye 4, as can be seen in particular in FIG. 2. Next to this greatest size of the triangular cross-section the size is reduced in the direction toward the needle eye 4 whereby the needle shaft in the area of the needle eye 4 is provided with a circular outer contour. The shaft portion 3 has also a circular outer contour indicated in a dash-dotted line in FIG. 4.

The approximately circular outer contour of the needle shaft within the area of the needle eye 4 has a reduced dimension relative to the end piece 5 and is thus exposed to a reduced friction when the sewing machine needle is guided through the textile material. Due to the reduced friction a local reduction of the frictional heating of the sewing machine needle caused. This effect of reducing the local temperature may be enforced by further reducing the outer contour, respectively, dimensions of the area of the needle shaft in the area of the needle eye so that the approximately circular cross-section within the area of the needle eye 4 is smaller than the circular cross-section of the shaft portion 3.

Due to the aforedescribed design of a sewing needle shown in the drawings a free stitching effect for the thread-guiding eye portion of the needle is generated which results essentially in a reduced thermal load of the sewing thread, the textile material, and also the needle. Accordingly, the danger of needle breakage or melting of the synthetic fiber components during sewing is reduced; furthermore, a substantial increase of the sewing distance until thread breakage occurs is achieved even under critical sewing conditions.

The present invention is, of course, in no way restricted to the specific disclosure of the specification and drawings, but also encompasses any modifications within the scope of the appended claims.

What I claim is:

1. A sewing machine needle comprising:

a piston for inserting said needle into the sewing machine;

a needle shaft comprised of a shaft portion and an end piece with a tip, said needle shaft having a needle eye between said shaft portion and said end piece for receiving a sewing thread;

a conical portion connected to said piston and forming a transition between said piston and said needle shaft;

said end piece, between said tip and said needle eye, having a radial cross-section of a triangular shape with rounded corners, with a size of said radial cross-section of triangular shape increasing from said tip toward said needle eye, said radial cross-section of triangular shape having a greatest size in the vicinity of said needle eye; and said needle shaft, in the area of said needle eye, having an essentially circular cross-section, wherein said circular cross-section is smaller than said greatest size of said radial cross-section of triangular shape of reducing a thermal load on the sewing thread.

2. The sewing machine needle according to claim 1, wherein said circular cross-section is smaller than a cross-section of said shaft portion.

* * * * *